US005152935A

United States Patent [19]

Robertson

[11] Patent Number: 5,152,935

[45] Date of Patent: Oct. 6, 1992

[54] CARBONATION SYSTEM

[76] Inventor: Colin T. Robertson, 2505 Hibiscus Pl., Fort Lauderdale, Fla. 33301

[21] Appl. No.: 658,550

[22] Filed: Feb. 21, 1991

[51] Int. Cl.[5] ..... B01F 3/04

[52] U.S. Cl. ..... 261/140.1; 261/DIG. 7; 261/59; 261/64.1

[58] Field of Search ..... 261/DIG. 7, 59, 64.1, 261/140.1

[56] References Cited

U.S. PATENT DOCUMENTS

| | | | |
|---|---|---|---|
| 2,194,775 | 3/1940 | Stadtfeld | 261/DIG. 7 |
| 3,074,700 | 1/1963 | Buttner, Sr. et al. | 261/DIG. 7 |
| 4,343,824 | 8/1982 | Caldwell | 261/DIG. 7 |
| 4,391,762 | 7/1983 | Child et al. | 261/DIG. 7 |
| 4,764,315 | 8/1988 | Brusa | 261/DIG. 7 |
| 4,940,164 | 7/1990 | Hancock et al. | 261/DIG. 7 |
| 4,950,431 | 8/1990 | Rudick et al. | 261/DIG. 7 |

FOREIGN PATENT DOCUMENTS

| | | | |
|---|---|---|---|
| 2157963 | 11/1985 | United Kingdom | 261/DIG. 7 |

*Primary Examiner*—Tim Miles
*Attorney, Agent, or Firm*—M. K. Silverman

[57] ABSTRACT

Provided is a carbonation system which does not require repetitive steps of manually refilling a water container thereof. The system sets forth a combination of a pre-cooled water source, a carbonation vessel, a assembly for regulating an inflow of pre-cooled water from the water source to the carbonation vessel, a source of compressed carbonation gas having an input to the carbonation vessel, and an assembly for providing selectable bursts of the carbonation gas to the carbonation vessel after the carbonation vessel has been filled, between defined maxima and minima, with a quantity of pre-cooled water. By the use of an external faucet, carbonated water may be removed from the carbonation vessel. A burst of carbonation gas is provided to the chilled water in the carbonation vessel after it is filled. The vessel is also immersed in the source of pre-cooled water. The vessel will self-fill after the carbonated water is drawn off.

4 Claims, 4 Drawing Sheets

CARBONATION SYSTEM

BACKGROUND OF THE INVENTION

In the prior art of consumer-use carbonation systems as, for example, in those environments other than commercial soda dispensing locations, it is necessary to hand-fill the tank or water container, typically using tap water and moving the tap water into the carbonation chamber of the carbonating system.

The difficulty with this approach is that the temperature of the water to be carbonated is not as low as is desirable for optimal and cost-effective carbonation in that carbonation of water becomes more difficult in direct relation to temperature.

A further shortcoming of the prior art lies in the process of filling, typically by hand, of the water-containing carbonation chamber. This step gives rise to considerable ranges in the level to which the chamber may be filled. As is known in the art of providing carbonation to water, if the water carbonation chamber is over-filled, there will not exist sufficient available volume within the chamber to permit the input of gas or to facilitate the dispersal of the carbonation within the vessel. Conversely, if the vessel is not sufficiently filled with water, the carbonating gas, typically carbon dioxide, will not be efficiently employed, i.e., it will be wasted.

Also, there has not existed in the prior art a portable cold water dispensing system, such as the type typically used in many offices, homes and businesses which has, combined therein, a self-carbonating capability. Further, such a capability has not existed with on-line water fountains or in cold-water dispensing refrigerators.

The most related art known to the inventor comprises U.S. Pat. Nos. 4,509,569; 4,564,126; and 4,588,536, all to Adolfsson which patents relate to systems for supplying gas to a container held liquid.

SUMMARY OF THE INVENTION

The present invention relates to a system for carbonating water which does not require reiterative steps of refilling a water container.

More particularly, a water carbonization system disposed internally to a water cooler is provided in which there is a continuous supply of properly carbonated water. The only component that must be periodically changed is a compressed carbon dioxide gas canister and a jug of water, or the like, if the system is not connected in-line with an external water source.

The system includes, disposed within a refrigeration means, a supply of cooled water to a carbonation vessel within which the vessel is immersed. Through the used of a check valve, float valve, solenoid valve or like means, the level of cooled water provided to the carbonation vessel is controlled as the water reaches a desired height within the vessel. A second input, at a lower level within said carbonation vessel, is a supply of carbon dioxide gas. The carbonation function is facilitated by virtue of the use of pre-cooled water from the refrigeration means. An outlet from the carbonation chamber is provided to the end user through a faucet or tube connected to a faucet.

It is accordingly an object of the present invention to provide a water carbonation system having particular utility in water coolers and refrigerators.

It is another object of the present invention to provide a more efficient and convenient-to-employ water carbonation system than is known in the art.

The above and yet other objects and advantages of the present invention will become apparent in the hereinafter set forth Brief Description of The Drawings, Detailed Description of the Invention and Claims appended herewith.

DETAILED DESCRIPTION OF THE INVENTION

Figure 1:
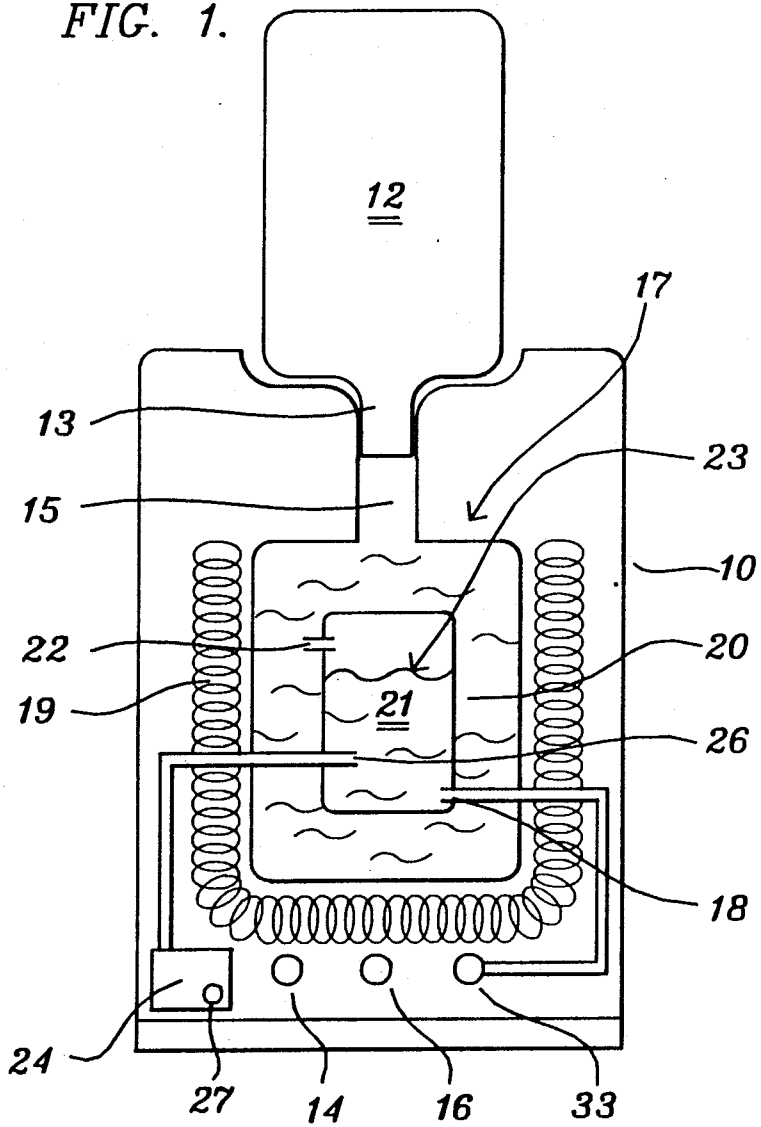
FIG. 1 is a schematic view showing, in a cross-section, a bottled water cooler in accordance with the present invention.

With reference to the cross-sectional schematic view of FIG. 1, a prior art water cooler 10 is seen to include a replaceable, typically, five gallon jug 12 of water. Through the force of gravity, water will flow through neck 13 of jug 12, and therefrom into a chilling compartment 17. The chilling compartment is surrounded by refrigeration coils 19 which operate to cool the water compartment to between 33 and 50 degrees Fahrenheit.

Cooled water from compartment 17 passes through conduit 22 into a carbonation vessel 20 which is automatically filled to a predetermined level 23. In FIG. 1 it is noted that the vessel 20 is immersed in the chilled water of refrigeration compartment 17. The predetermined level 23 can be achieved through a variety of means. For example, a pressure sensitive check valve 32 may be employed within water conduit 22 so that the flow of water into vessel 20 simply terminates whenever a pre-determined volume of water is passed through conduit 22. See FIG. 4. The check valve 32 and vertical height of conduit 22 assure that the vessel 20 will be filled between defined maxima and minima of water 21.

Figure 5:
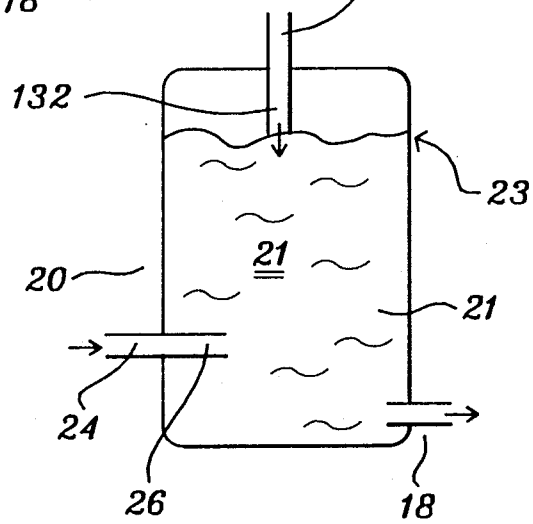
FIG. 5 is a schematic view of the second embodiment of the carbonation vessel.

Another configuration for the assembly of vessel 20 is shown in FIG. 5 in which a chilled water conduit 122 is employed. In this method, water will continue to flow into vessel 20 until the water level 23 reaches an appropriate point 132 of conduit 122. At that point the entraped air or carbon dioxide gas will automatically build-up to thereby effect the proper level of the non-carbonated water. An appropriate valve in conduit 122 will close to seal vessel 20 to re-set for the next carbonation.

Figure 6:
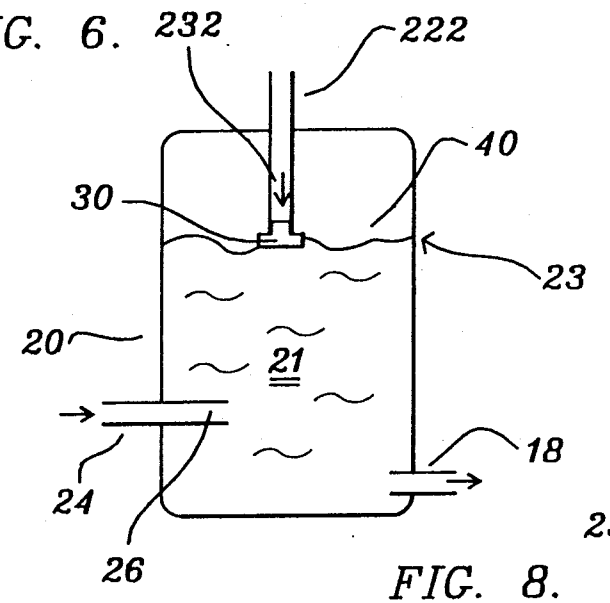
FIG. 6 is a schematic view of the third embodiment of the carbonation vessel.

In FIG. 6 is shown a third assembly for cutting-off the chilled water input. Therein, a float valve 30 is employed which is maintained in-line with opening 232 of conduit 222. When water 21 reaches the desired level 23, the float valve 30 will simply prevent further input of water from cold water conduit 222 into vessel 20, and seal-off conduit opening 232 until the next carbonation.

With further reference to FIGS. 1, 4, 5 and 6 there is shown a carbon dioxide cylinder 24 mounted externally to cooler 10 which provides an input 26 of carbonation to vessel 20. This input 26 of gas is necessary to effect carbonation. One burst or more bursts of carbon dioxide, actuated by manually operable means 27, will typically follow each filling of the vessel 20.

The effectiveness of carbonation is a function of the temperature of the water, the pressure of carbon dioxide gas to be carbonated, and the available void space 40 for expansion and mixing of the carbonated gas within the water. Accordingly, for efficiency of operation, a constant source of chilled water is necessary as is a controlled volume of water to be carbonated.

Figure 2:
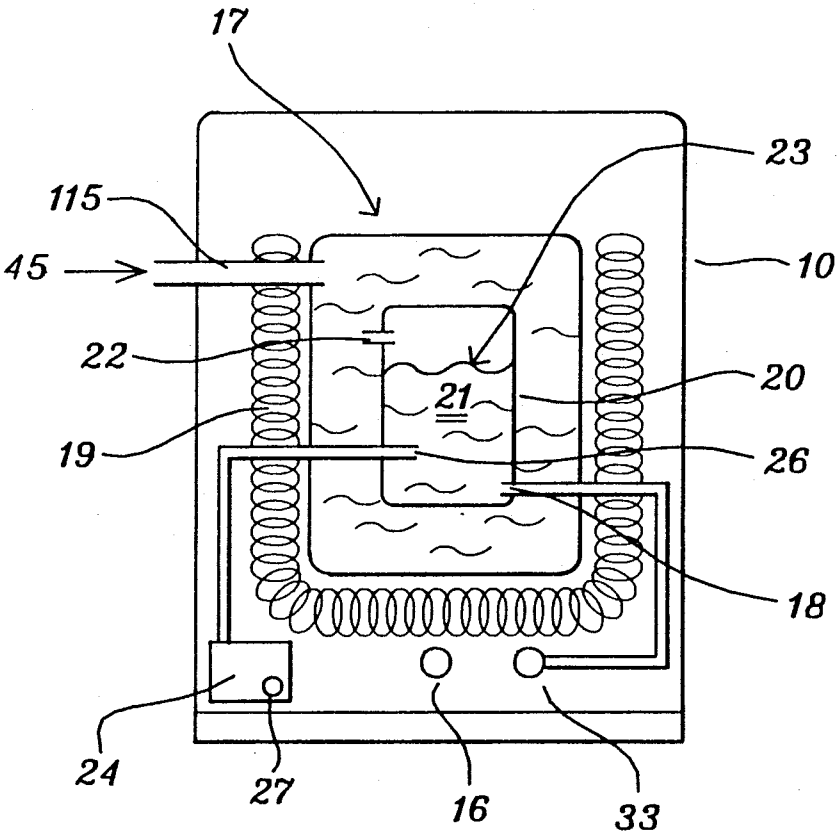
FIG. 2 is a schematic view showing, in cross-section, a water cooler having an in-line connection to a continuous external water supply.
Figure 4:
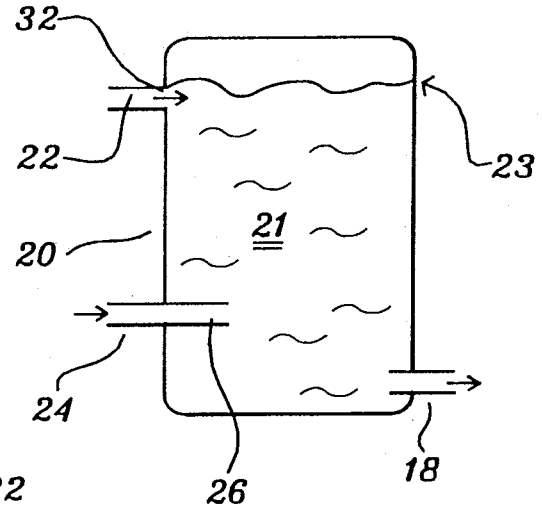
FIG. 4 is a schematic view of one embodiment of a carbonation vessel in accordance with the present invention.

At the lower right of FIGS. 4, 5 and 6 is shown an outlet 18 which leads to a faucet 33 of FIGS. 1 and 2.

The result of the above system is a consumer-usable device, that is, a system which, externally, simply attaches to a water cooler. Such a system can be provided with a chilled water faucet 16 and said carbonated water faucet 33.

It is noted that after withdrawal of carbonated water at faucet 33, gas pressure within line 18 will preclude accumulation therein of water. Thusly, an user will not receive warm water upon the next use of the system.

In another embodiment of the invention, shown in FIG. 2, the source of water may be that of an in-line external supply of water 45, rather than jug 12.

Figure 3:
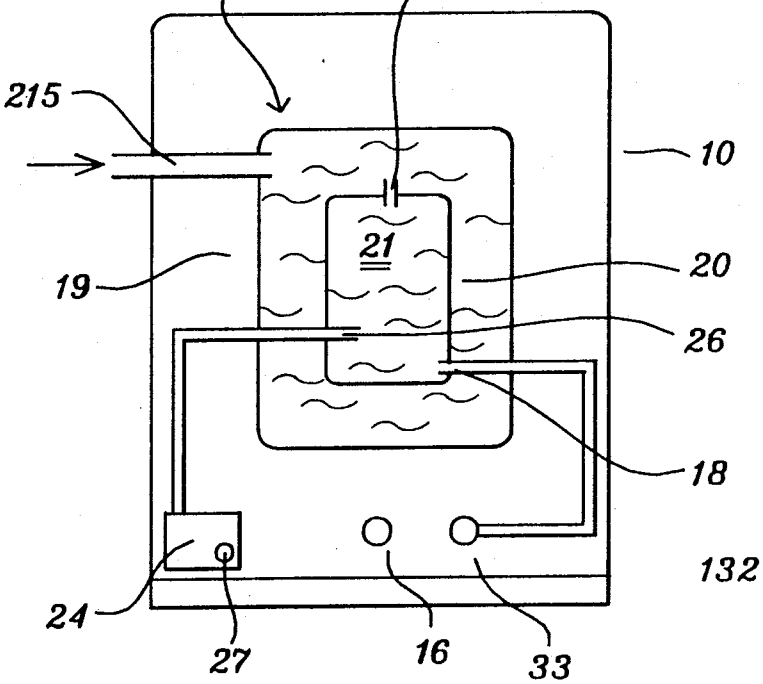
FIG. 3 is a schematic view showing the inventive system adapted to use in a refrigerator.

A further embodiment, for use in a refrigerator, is shown in FIG. 3. As in the embodiments of FIGS. 1 and 2, the carbon dioxide cylinder 24 is externally mounted to the housing of the cooler 10 or outside of a refrigerator.

It is to be appreciated that, in other embodiments, cylinder 24 may be outside of refrigeration compartment 17. Also, the faucet 33 for outlet 18 may be attached directly to vessel 20 or may be connected externally using a conduit connection.

Figure 7:
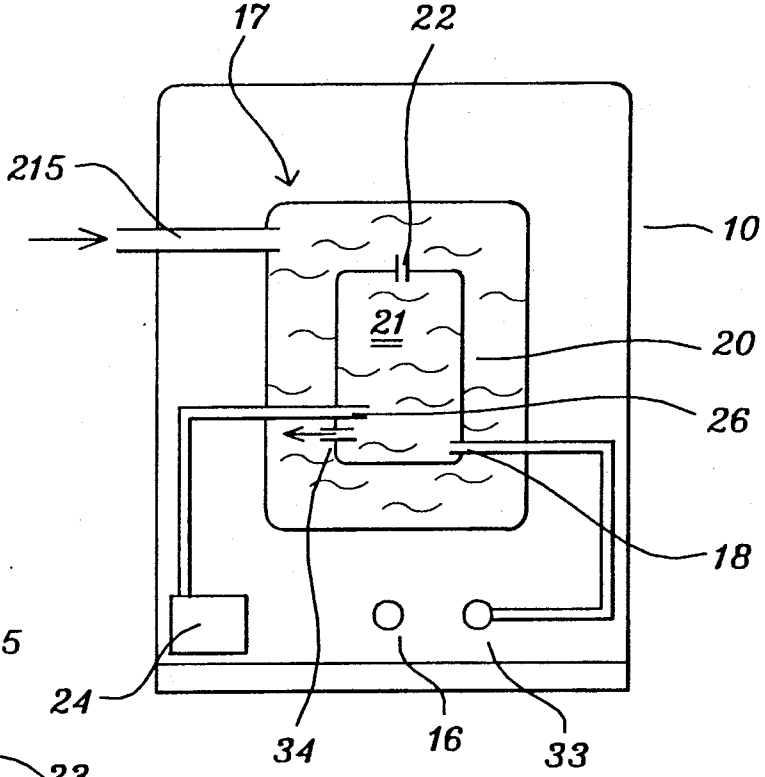
FIG. 7 is a schematic view similar to the view of FIG. 3, however, showing the system provided with a liquid pressure relief valve within the carbonation vessel.

A further embodiment of the instant invention which is applicable to all of the above described embodiments is shown in FIG. 7. Therein is provided a liquid pressure relief valve 34, within the wall of carbonation vessel 20, at a location beneath input 26 of carbon dioxide cylinder 24. The function of said valve 34 is to permit filling of vessel 20 to a pre-determined maximum pressure level to thereby maximize the efficiency of carbonation of water 21 within vessel 20. Valve 34 may, for example, comprise an adjustable, spring-actuated, O-ring seal, liquid pressure relief valve or a diaphragm liquid pressure relief valve.

When the actuation (cracking) pressure within vessel 20 is exceeded, which may occur during the carbonation cycle, excess water 21 will be released into refrigeration compartment 17.

Figure 8:
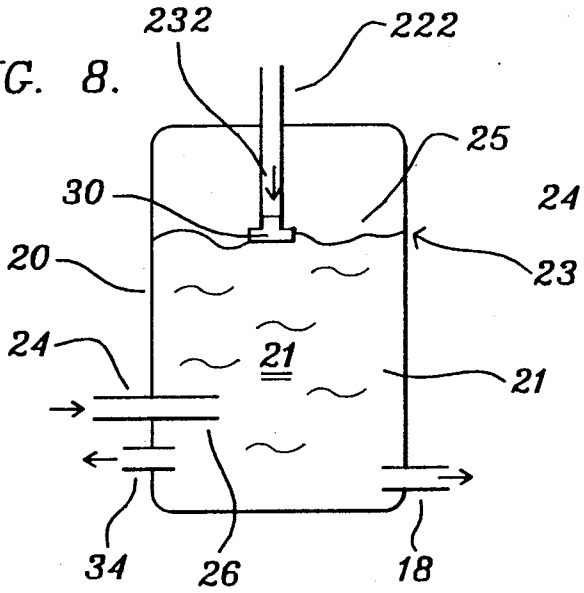
FIG. 8 is an enlarged view of the embodiment of FIG. 7 adapted to the embodiment of FIG. 6.

Alternatively (see FIG. 8) a separate conduit from the pressure relief valve 34 may be provided to discharge fluid directly into a cup or receptacle for receiving the carbonated water.

Figure 10:
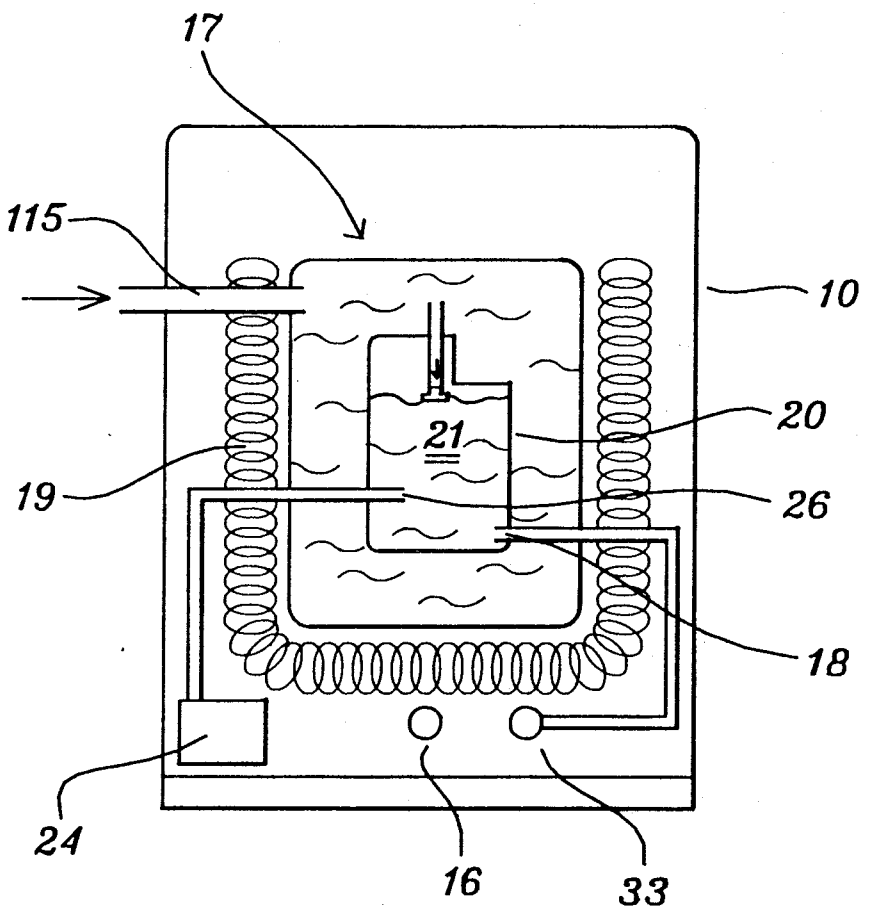
FIG. 10 is an enlarge view of the entire system, using the embodiment of FIG. 9.
Figure 9:
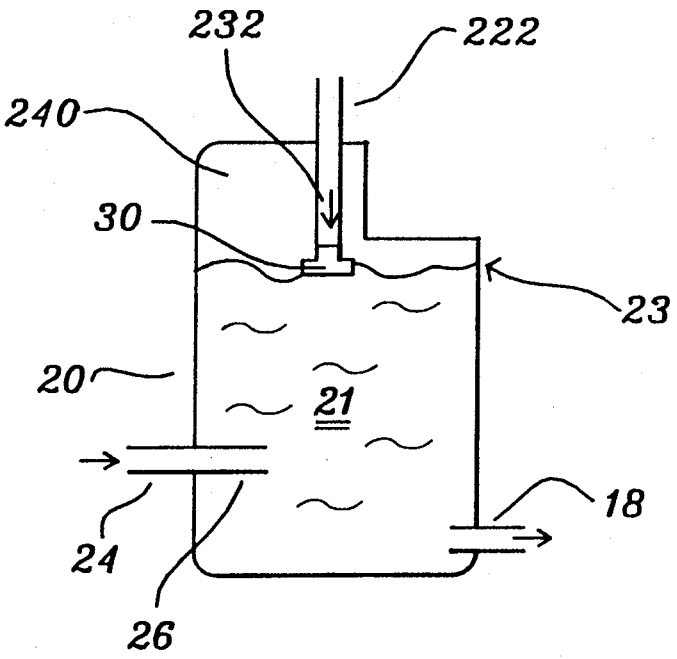
FIG. 9 is a schematic view, similar to the embodiment of FIG. 6, however, showing a modification thereof.

With regard to FIGS. 9 and 10 there is shown a yet further embodiment in which the ratio of the volume of void space 240 to water 21 of vessel 20 differs from the ratio of the volume of void space 40 to water 21 in the embodiment of FIG. 6. Such a method of changing these volumetric ratios is applicable to any of the embodiments of this invention.

As above noted the effectiveness of carbonation is a function of the temperature of the water 21, the pressure of the carbonation gas, and the available void space 40/240 for expansion and mixing of the gas within the water 21. Thereby, the embodiment of FIGS. 9 and 10 comprises a means for changing these variables to thus effect the carbonation process.

I have found that the above represents a cost-effective means for providing carbonation to chilled water such that cold carbonated water may be provided to the consumer at a cost far below that which is now available in the industry.

Accordingly, while there has been shown and described a preferred embodiment of the instant invention it is to be appreciated that the invention may be embodied otherwise than is herein specifically shown and described and within said embodiment certain changes may be made in the form and arrangement of the parts without departing from the underlying idea of principles of this invention within the scope of the Claims appended herewith.

Having thus described my invention what I claim as new, useful and non-obvious and, accordingly, secure by Letters Patent of the United States is:

1. A system for the selective carbonation of individual servings of pre-cooled water, comprising:

(a) a vessel comprising a source of pre-cooled water, pre-cooling thereof being in the range of between about 33 and about 50 degrees Fahrenheit;

(b) a carbonation vessel completely enclosed within said water source vessel, and immersed within water contained therein and in thermal communication with said water of said water vessel, said carbonation vessel having an input conduit to an interior of said water vessel, said conduit comprising means for gravity-assisted liquid communication to a pre-determined maximum level of liquid to thereby define a desired ratio of liquid volume to gas volume in an interior of said carbonation vessel, said carbonation vessel having a top and a bottom, and further having a gas conduit input and a water conduit output, both situated near said bottom of said carbonation vessel;

(c) a re-sealable fluid pressure relief valve located within a wall of said carbonation vessel, said pressure relief valve comprising means for self-regulation of the pressure of water in said carbonation vessel;

(d) a source of compressed carbonation gas having an output in selectable fluid communication with said gas input to said carbonation vessel;

(e) manually operable means for providing selectable bursts of said carbonation gas into said carbonation vessel; and (f) manually-operable means for permitting selectable outflow of carbonated water from said water output of said carbonation vessel.

2. The system as recited in claim 1 in which said carbonation gas comprises carbon dioxide.

3. The system as recited in claim 1 in which said means for liquid communication from said water vessel to said carbonation vessel comprises: a check valve.

4. The system as recited in claim 1 in which said source of pre-cooled water comprises: an in-line external continuous water supply.

* * * * *